US006446398B2

(12) United States Patent
Weir

(10) Patent No.: US 6,446,398 B2
(45) **Date of Patent: *Sep. 10, 2002**

(54) UNIVERSAL DIRECTION POST AND WALL PANEL ADAPTER

(76) Inventor: Richard L. Weir, 3106 Canterbury La., Largo, FL (US) 33770

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/480,626

(22) Filed: Jan. 10, 2000

(51) Int. Cl.[7] ..... E04B 1/38

(52) U.S. Cl. ..... 52/71; 52/281; 52/282.2; 52/582.1; 160/135

(58) Field of Search ..... 52/281, 282.2, 52/582.1, 71, 271, 235; 160/135

(56) References Cited

U.S. PATENT DOCUMENTS 1,834,512 A * 12/1931 Asmus ..... 52/65
3,256,655 A * 6/1966 Teeter ..... 52/127.5
3,559,352 A * 2/1971 Magnuson ..... 52/36.4
3,781,944 A * 1/1974 Gianardi ..... 160/135
4,371,148 A * 2/1983 Harden ..... 160/135
4,968,171 A * 11/1990 Shell ..... 403/4
5,107,652 A * 4/1992 Sosa ..... 52/578
5,363,616 A * 11/1994 Hernandez ..... 52/281
5,426,822 A * 6/1995 Weir ..... 16/392
6,041,563 A * 3/2000 Vollers ..... 52/281

* cited by examiner

*Primary Examiner*—Carl D. Friedman
*Assistant Examiner*—Jennifer I. Thissell

(57) ABSTRACT

A hinge type post adapter, as part of a panel and post wall system, with circular loops or nuckles in horizontally extended sections, which fit snugly around the post, with a "U" shaped slot extending outwardly from the opposite side from top to bottom, with slots slightly wider than the loops or nuckles in the loop section, to allow an identical part to be inserted around the post upside down. It should be noted that the post adapters, when installed on the post will allow an extension of the wall in any desired direction around the post from 90 to 180 degrees from the proceeding wall section and will prohibit the transmittal of water or air thru the wall assembly.

1 Claim, 5 Drawing Sheets

UNIVERSAL DIRECTION POST AND WALL PANEL ADAPTER

IN THE DRAWINGS

IN DETAIL THEN

Figure 2:
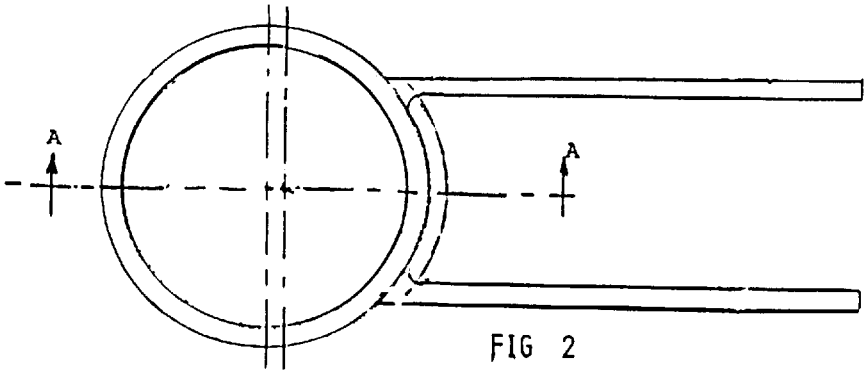
FIG. 2 is a top view of the Slotted panel and loop assembly
Figure 1:
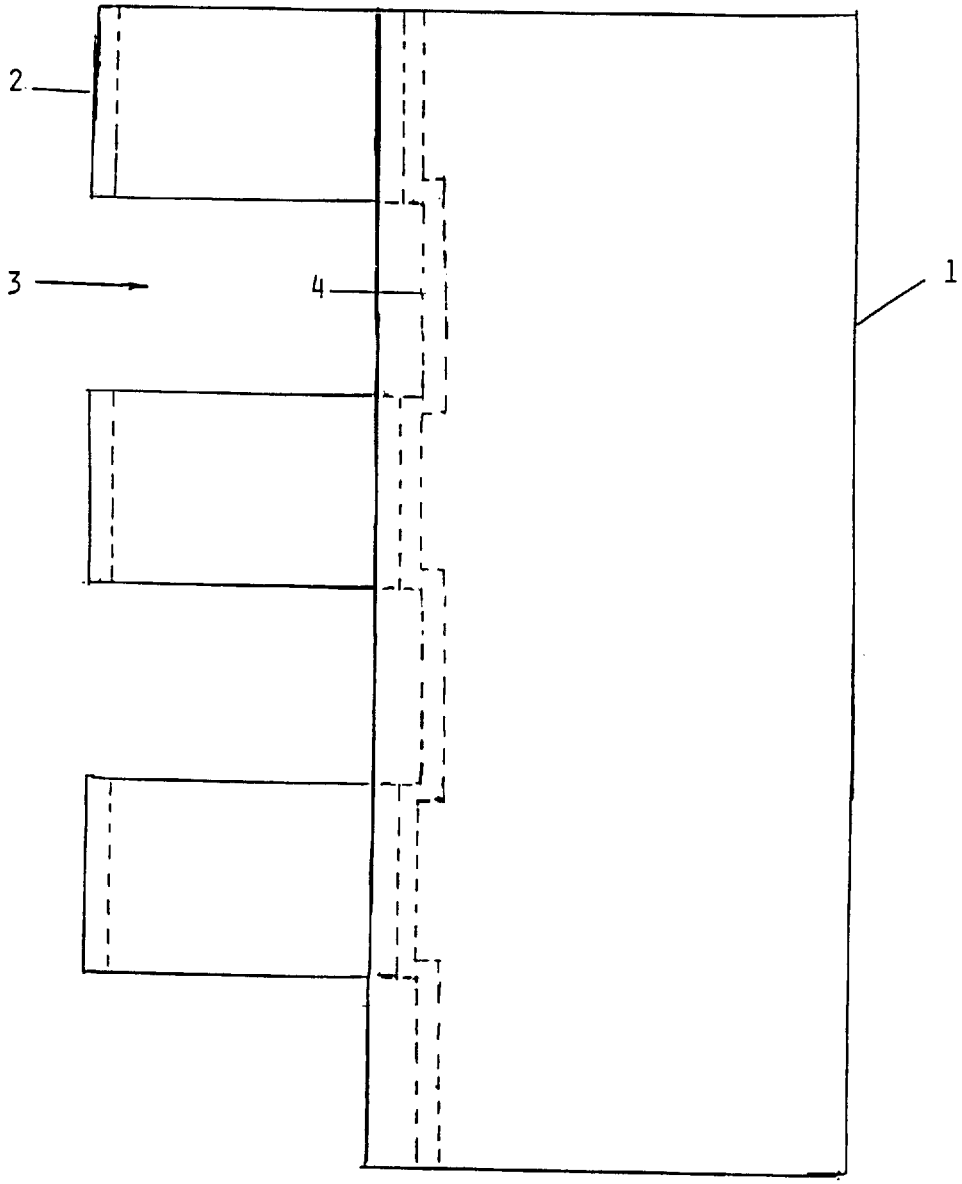
FIG. 1 is a side view of the slotted panel and loop assembly
Figure 3:
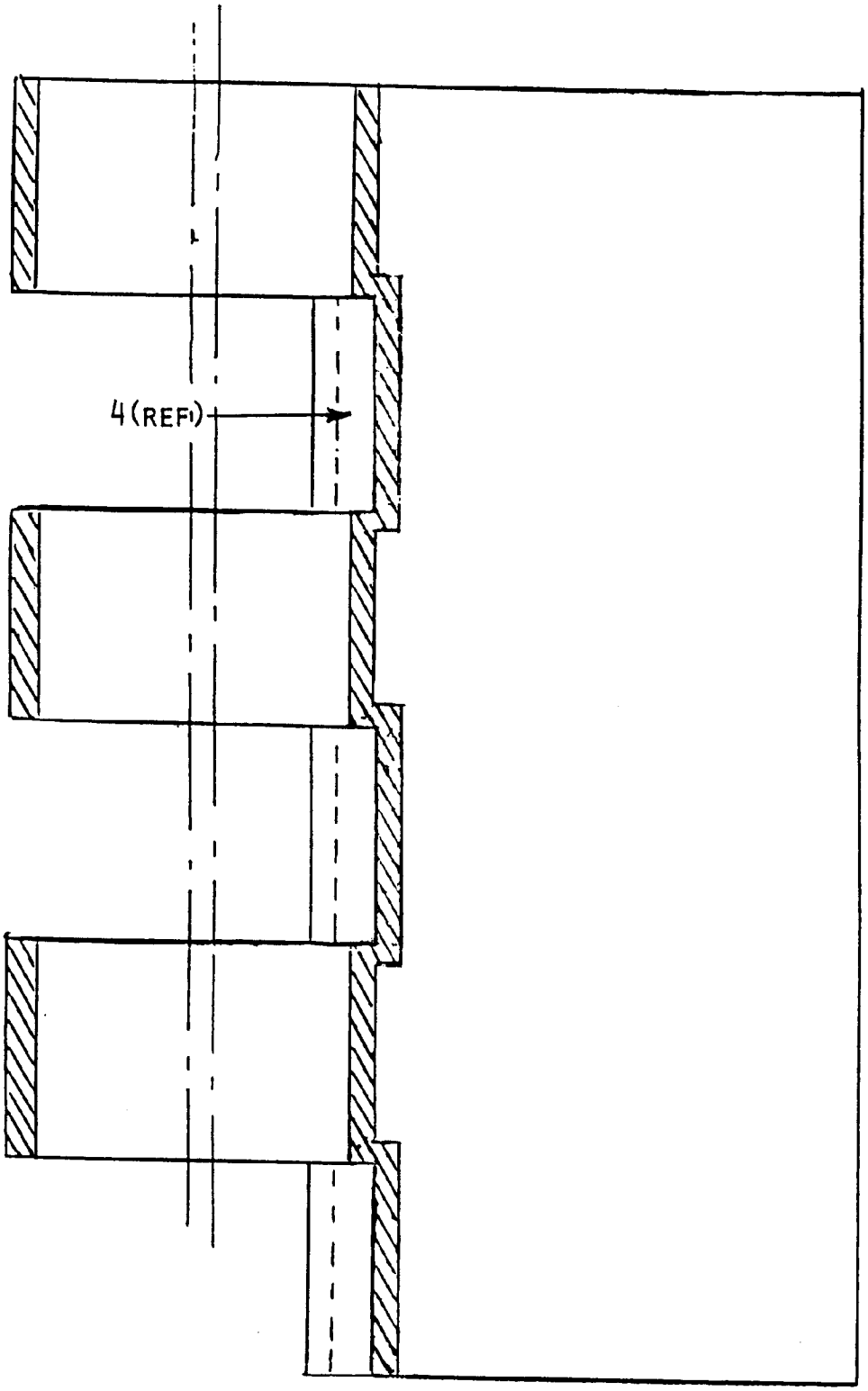
FIG. 3 is a cross section view of the slotted panel and loop assembly taken along the line A—A
Figure 5:
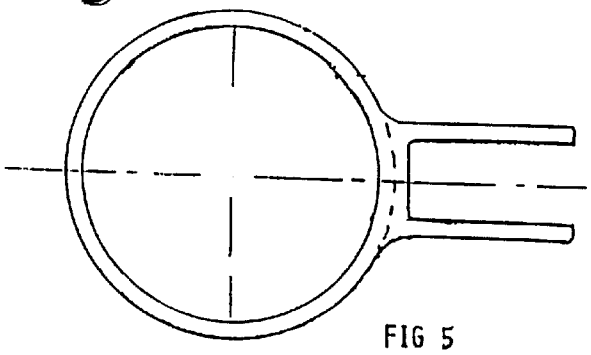
FIG. 5 is a top view of FIG. 4
Figure 4:
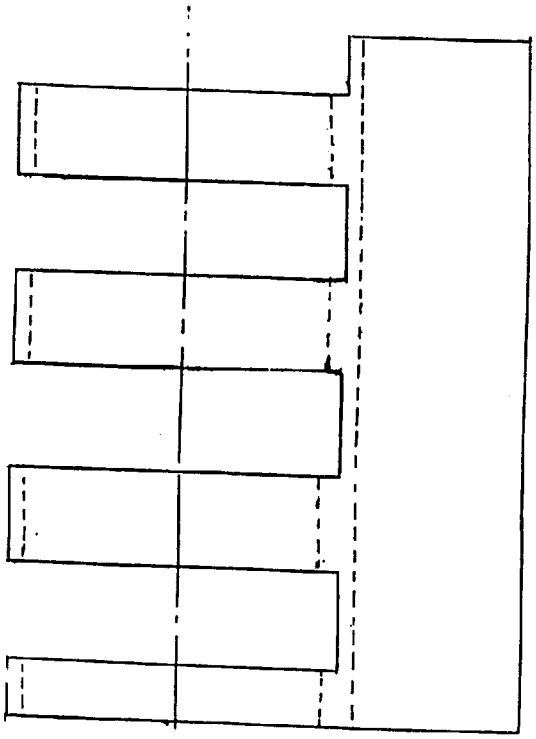
FIG. 4 is an alternate side view of a panel and loop assembly of a slightly different configuration.
Figure 7:
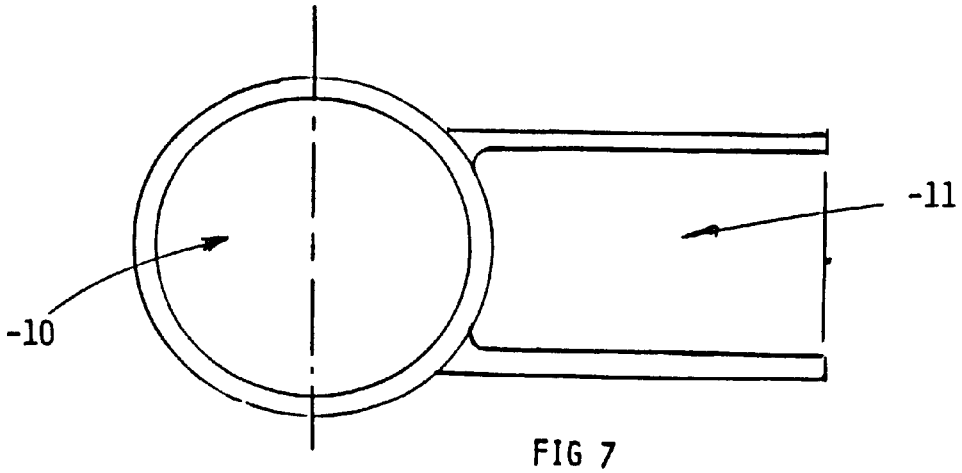
FIG. 7 is a top view of a single component connector element
Figure 8:
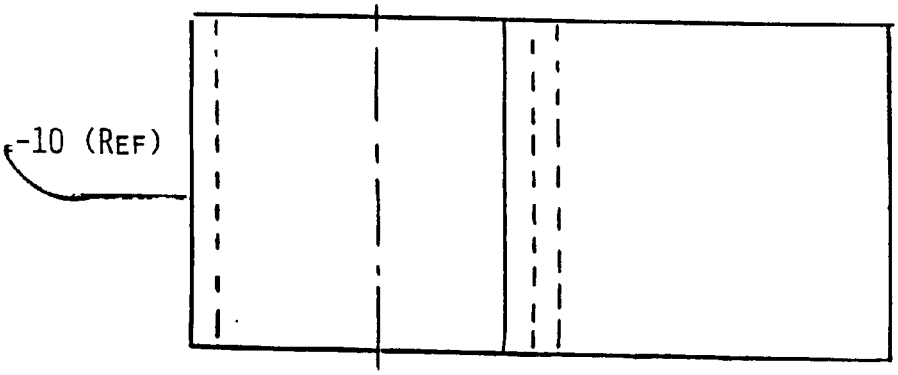
FIG. 8 is a side view of a single component connector element

In FIG. 1 , -1 is the is the side of a slotted side panel . -2 is a typical cylindrical loop section of the side panel. -3 is a typical void section in the side panel which is slightly wider than the cylindrical loop section to allow an adjoining loop section from an inverted unit to slide into position within the semi circular section adjacent to the void area.-4. (See FIG. 3 depicting the of-set). When an inverted unit is slid into an upright section a continous cylindrical hollow section is provided in the assembly which may then be inserted around a vertical round post. As multiple units are assembled on a post a continuous slot is provided for insertion of plank like panels between posts. The direction of the fence or wall may be changed at each post by rotating the loop and panel units installed on the posts to the desired direction. FIGS. 4 and 5 depict a slightly different design of the panel and loop parts in which extrusion fabricated parts may be slotted in a secondary operation.

Figure 6:
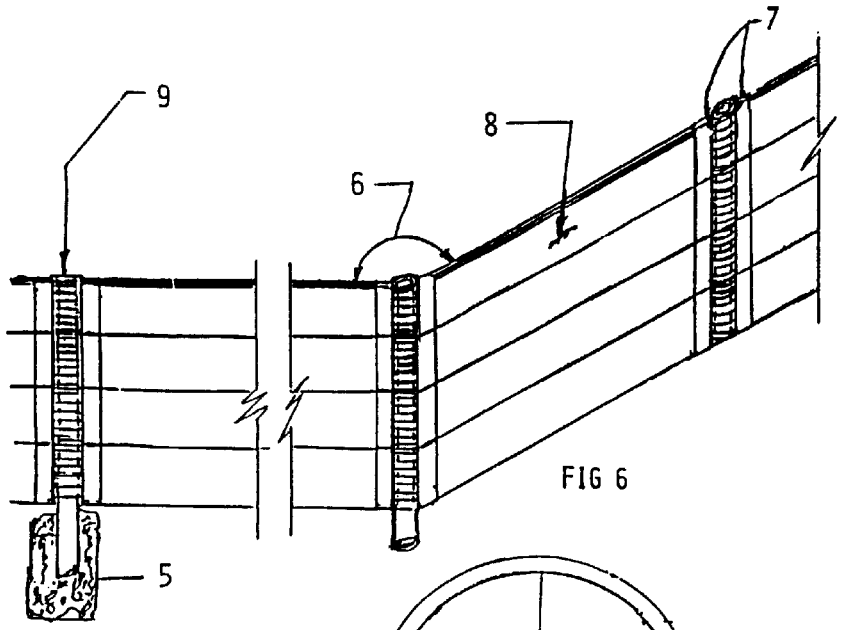
FIG. 6 is an assembly view of a fence installation with plank like panels inserted in slotted panel and loop components installed on posts.

In FIG. 6, -5 illustrates a concrete fill around the base of a vertical post. -6 illustrates a typical angular installation of a fence or wall which may be varied as desired. -7 indicates typical -1 parts as assembled around a post. -8 is a typical plank like panel which may interlock with adjoining panels.

-9 is an optional post cap which may hold the panels forming the wall in position.

Figure 9:
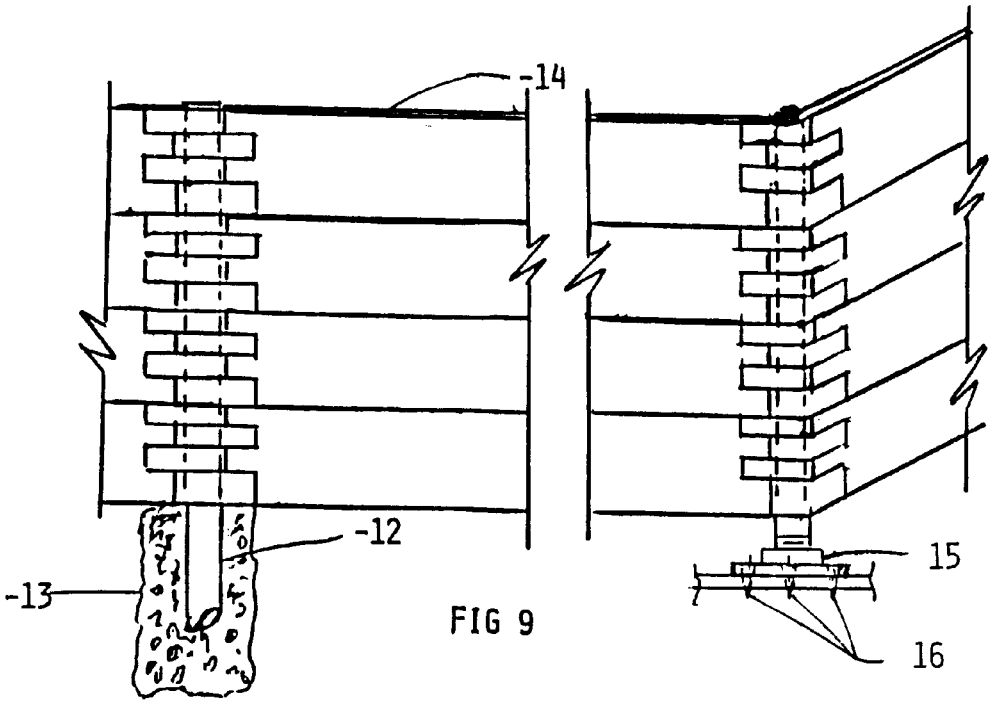
FIG. 9 is an assembly illustration of multiples of single element components installed on posts with plank like wall panels inserted, with alternate post base installations illustrated.

In FIG. 7 -10 indicates the loop section of a single component connector and -11 indicates the space between the vertical sides of the connector which retain the vertical plank like panels. In FIG. 9 the loop sections -10 of the single component connectors are stacked with single loop connector spaces -11 on opposite sides of the vertical post -12, the bottom end of which may be burned in concrete -13 to retain the post in vertical position. An alternate support for the base of the posts is illustrated by using pipe posts and a commercial standard pipe flange -15, which may be bolted to a flat surface such as concrete with bolts -16, and the lower end of the pipe threaded and screwed into the flange. An angular direction of the fence or wall may be accomplished by rotating half of the single component connectors to the desired angle before inserting the vertical planks -14. It will thus be seen that single component connectors may be used in erecting vertical walls or fencing as well as multiple unit connectors as described earlier herein.

Figure 10:
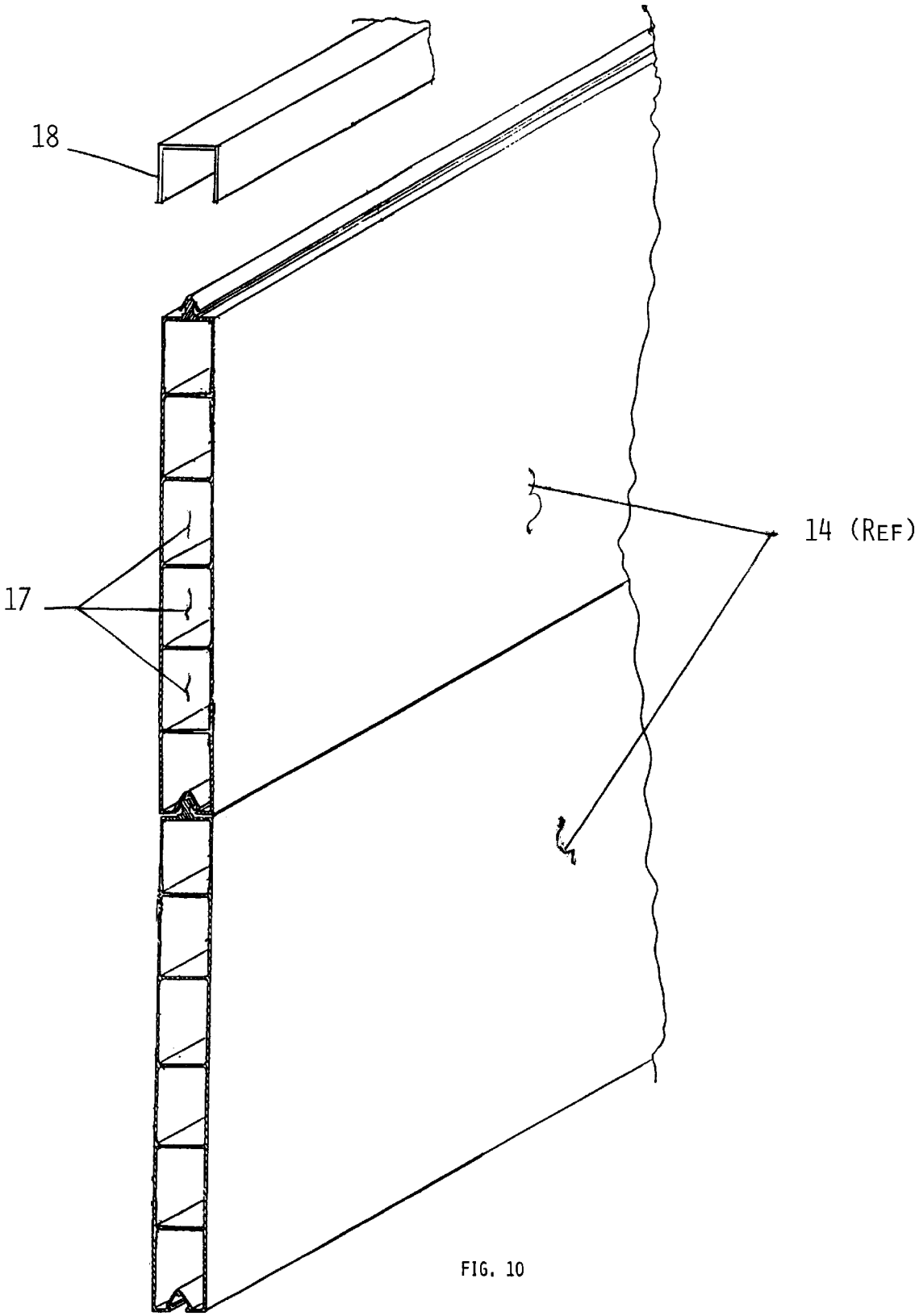
FIG. 10 is an isometric illustration of assembled snap together interlocking panels and a typical wall cap.

In FIG. 10, hollow plank like interlocking panels -14(ref.) may snap together to form a continuous wall or roof of a structure. Voids -17 in the vertical panels may be filled with airated cement for sound deadening effect and structural integrity A solvent adhesive, not shown, may be applied to mating interlocking elements of the panels for roof sections, and the assembled roof sections sections screwed to the walls thru the wall cap for a waterproof structure. A "U" shaped wall cap 18 may be provided as a trim strip or base for a flat roof structure on top of the walls.

What is claimed is:

1. A post and wall adapter system comprising an adapter having two sides that are aligned with one another, the first side has a plurality of spaced cylindrical knuckles, each knuckle having an opening, all of the openings are aligned above one another and are capable of receiving a post, the second side of the adapter has a continuous U-shaped slot that extends the entire length of the adapter in the same direction as the openings of the knuckles, the knuckles on the first side of the adapter are connected directly to the second side of the adapter at the curved portion of the U-shaped slot, a second adapter that is identical to the first adapter is adapted to be placed upside down and the knuckles of the second adapter are interlocked with the knuckles of the first adapter to form a continuous opening, the continuous opening receives a pole allowing the adapters to rotate, hence allowing the U-shaped slots to be located at any angle up to 180 degrees apart, a plurality of panels with longitudinal upper and lower edges and side edges, the upper and lower edges of the panels adapted to interlock one atop another, and the U-shaped slots to receive the panels at the side edges of the panel.

* * * * *